US009714531B2

(12) United States Patent
Vigneau et al.

(10) Patent No.: US 9,714,531 B2
(45) Date of Patent: Jul. 25, 2017

(54) PUSH-PUSH LATCH ARRANGEMENT

(71) Applicant: Faurecia Interior Systems, Inc., Auburn Hills, MI (US)

(72) Inventors: Larry Vigneau, Auburn Hills, MI (US); Brian Vigneau, Auburn Hills, MI (US)

(73) Assignee: FAURECIA INTERIOR SYSTEMS, INC., Auburn Hills, MI (US)

( * ) Notice: Subject to any disclaimer, the term of this patent is extended or adjusted under 35 U.S.C. 154(b) by 260 days.

(21) Appl. No.: 13/958,051

(22) Filed: Aug. 2, 2013

(65) Prior Publication Data

US 2015/0035293 A1 Feb. 5, 2015

(51) Int. Cl.

| | |
|---|---|
| ***E05C 3/02*** | (2006.01) |
| ***E05B 83/28*** | (2014.01) |
| ***E05B 77/42*** | (2014.01) |
| ***E05C 19/02*** | (2006.01) |

(52) U.S. Cl.

CPC ..... *E05B 83/28* (2013.01); *E05B 77/42* (2013.01); *E05C 19/022* (2013.01); *Y10T 292/1078* (2015.04)

(58) Field of Classification Search

CPC ..... E05C 19/024; E05B 65/0046
USPC ..... 292/198
See application file for complete search history.

(56) References Cited

U.S. PATENT DOCUMENTS

| | | | |
|---|---|---|---|
| 4,657,292 | A | 4/1987 | Bruck |
| 4,669,764 | A | 6/1987 | Bruck |
| 4,925,072 | A | 5/1990 | Masler et al. |
| 5,050,922 | A | 9/1991 | Falcoff |
| 5,267,761 | A | 12/1993 | Curtindale et al. |
| 5,647,578 | A | 7/1997 | Bivens |
| 5,657,969 | A | 8/1997 | Bivens |
| 5,845,954 | A | 12/1998 | DePue |
| 6,213,454 | B1 | 4/2001 | Bivens et al. |
| 7,055,883 | B2 | 6/2006 | Tokutomi et al. |

(Continued)

FOREIGN PATENT DOCUMENTS

| | | | |
|---|---|---|---|
| JP | 11051225 | A | 2/1999 |

OTHER PUBLICATIONS

USPTO, Office Action for U.S. Appl. No. 13/837,275, mailed Jan. 30, 2015.

*Primary Examiner* — Mark Williams
(74) *Attorney, Agent, or Firm* — Lorenz & Kopf LLP

(57) ABSTRACT

A push-push latch arrangement includes, but is not limited to, a movable component adapted for mounting to a vehicle interior and configured to move between a first position and a second position. The arrangement further includes a latch component configured to engage the movable component and configured to move with respect to the movable component as the movable component moves between the first and second positions. The arrangement further includes a push-push pathway associated with either the movable component or the latch component. The push-push pathway has an ingress segment, a confining segment, and an egress segment. The arrangement further includes a pathway follower associated with either the movable component or the latch component. The pathway follower is engaged with the push-push pathway. The arrangement still further includes a damper engaged with the latch component and configured to retard movement of the latch component with respect to the movable component.

13 Claims, 10 Drawing Sheets

(56) References Cited

U.S. PATENT DOCUMENTS

| | | | | |
|---|---|---|---|---|
| 7,097,220 | B2 | 8/2006 | Haba | |
| 7,231,692 | B2 | 6/2007 | Harada | |
| 7,793,995 | B2 | 9/2010 | King et al. | |
| 8,052,181 | B2 * | 11/2011 | Nishida | 292/332 |
| 2006/0054630 | A1 | 3/2006 | Katagiri | |
| 2006/0208506 | A1 * | 9/2006 | Kern | B60R 7/04 292/304 |
| 2007/0013197 | A1 * | 1/2007 | Bender | E05B 51/023 292/201 |
| 2010/0083779 | A1 | 4/2010 | Rhee | |
| 2011/0101712 | A1 * | 5/2011 | LaConte | E05B 17/0041 292/252 |

* cited by examiner

PUSH-PUSH LATCH ARRANGEMENT

TECHNICAL FIELD

The technical field generally relates to vehicles, and more particularly relates to push-push latch arrangements for use in vehicles.

BACKGROUND

When designing movable components such as bin covers, glove box closures, cell phone holders that open and close to receive a cellular telephone, and the like, for vehicle interiors, it is desirable to present a vehicle occupant with an uninterrupted surface. Uninterrupted surfaces are generally perceived as being more aesthetically pleasing than a surface having knobs, buttons, or other interruptions. The movement of such movable components from a closed position to an open position is commonly controlled by a latch arrangement. A conventional latch arrangement may use a button, a switch, a lever, a clasp or other release mechanism to lock and unlock movement of the movable component. Such release mechanisms visually disrupt an otherwise uninterrupted surface of the movable component.

One latch arrangement that avoids the use of a visible release mechanism is a conventional push-push latch arrangement. A conventional push-push latch arrangement enables a user to push on the movable component itself rather than actuating a button, a switch, a lever, a clasp, or any other visible actuator. In response to the push, hidden components of the conventional push-push latch arrangement will move with respect to one another and will cause the movable component to become locked in a closed position. A second push on the movable component will release the movable component and permit it to move to an open position. A further push will start the lock-unlock cycle over again.

While conventional push-push latch arrangements are aesthetically pleasing, under certain circumstances, they can be disadvantageous. For example, if the movable component is oriented such that the actuating push is aligned with the direction of vehicle travel, then in a head-on or a rear-end collision, the push-push latch arrangement may react to the collision force as though a push had been initiated. This, in turn, may allow the movable component to become unlatched and it may move to the open position. This is undesirable and may also run afoul of certain government regulations.

One known solution is described in U.S. Pat. No. 5,647,578, issued to Bivens and entitled "Latch Mechanism" (hereinafter, "Bivens"). While Bivens discloses the use of a damper in conjunction with a push-push latch mechanism to dampen the rate at which a movable component can move from its closed position to its open position, Bivens does not disclose a solution that inhibits the movable component from opening during a collision. Thus, while this solution may be fine for preventing damage to the movable component as it opens unexpectedly, it does not address the problem described above. Depending upon the severity of a collision, the forces exerted on a push-push latch arrangement made in accordance with Bivens' disclosure may cause the movable component to open during the collision despite the presence of the damper.

Accordingly, it would be desirable to introduce a push-push latch arrangement that does not open during a vehicle collision. Furthermore, other desirable features and characteristics will become apparent from the subsequent detailed description and the appended claims, taken in conjunction with the accompanying drawings and the foregoing technical field and background.

SUMMARY

A push-push latch arrangement is disclosed herein. In a non-limiting embodiment, a push-push latch arrangement includes, but is not limited to, a movable component that is adapted for mounting to an interior surface of a vehicle. The movable component is configured to move between a first position and a second position. The push-push latch arrangement further includes, but is not limited to, a latch component that is configured to engage the movable component. The latch component is configured to move with respect to the movable component as the movable component moves between the first position and the second position. The push-push latch arrangement further includes, but is not limited to, a push-push pathway that is associated with either the movable component or the latch component. The push-push pathway has an ingress segment, a confining segment, and an egress segment. The push-push latch arrangement further includes, but is not limited to, a pathway follower that is associated with either the movable component or the latch component. The pathway follower is engaged with the push-push pathway. The push-push latch arrangement still further includes, but is not limited to, a damper that is engaged with the latch component. The damper is configured to retard movement of the latch component with respect to the movable component.

BRIEF DESCRIPTION OF THE DRAWINGS

One or more embodiments will hereinafter be described in conjunction with the following drawing figures, wherein like numerals denote like elements.

DETAILED DESCRIPTION

Figure 1:
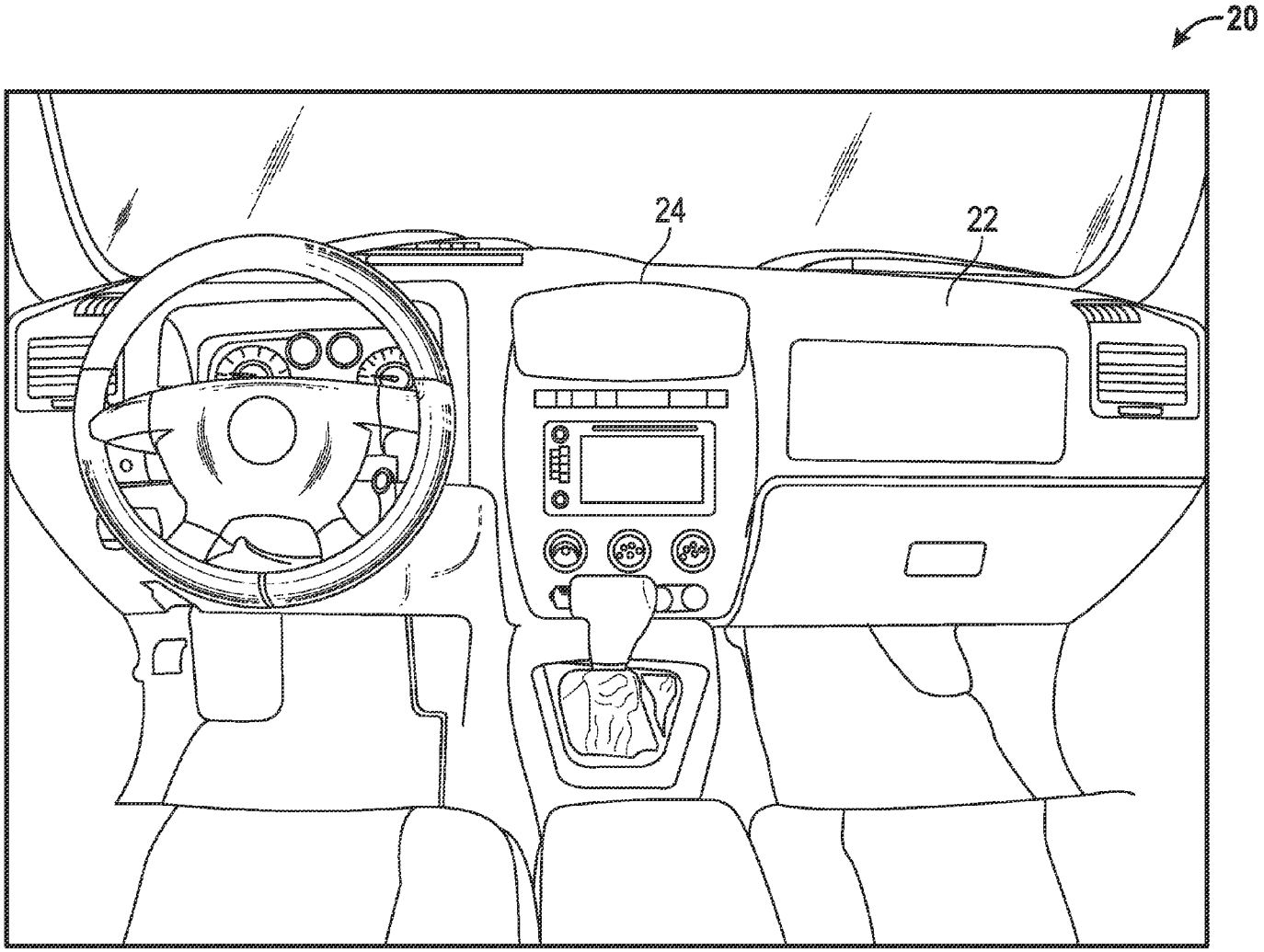
FIG. 1 is a perspective view illustrating a vehicle interior including an instrument panel and an integrated storage bin cover configured to move between an open position and a closed position.

The following detailed description is merely exemplary in nature and is not intended to limit application and uses. Furthermore, there is no intention to be bound by any expressed or implied theory presented in the preceding technical field, background, brief summary or the following detailed description.

One known example of a push-push latch arrangement is disclosed in pending U.S. patent application Ser. No. 13/837,275, the contents of which are hereby incorporated herein by reference. An improved push-push latch arrangement is disclosed herein. In a non-limiting embodiment, the push-push latch arrangement includes a movable component (e.g., a storage bin lid or a component associated or linked with a storage bin lid). The movable component is configured to move between a first position (e.g., an open position) and a second position (e.g., a closed position). In this non-limiting embodiment, a latch component is engaged with the movable component and moves with respect to the movable component as the movable component moves between the first and second positions. In this non-limiting embodiment, a push-push pathway is associated with either the movable component or the latch component. The push-push pathway has an ingress segment, a confining segment, and an egress segment. In this non-limiting embodiment, a pathway follower is associated with either the movable component or the latch component and engages the push-push pathway. In this non-limiting embodiment, a damper is engaged with the latch component and retards movement of the latch component with respect to the movable component.

As used herein, the term "push-push pathway" refers to a pathway that may be disposed on or defined in either the surface of the movable component or the surface of the latch component, or dispose on or defined in the surface of any other component. The pathway is configured to guide the pathway follower and commonly includes an ingress segment, a confinement segment, an egress segment, and in some embodiments, an over-shoot segment. These segments are generally contiguous and commonly configured to guide the pathway follower in such a manner that an initial push by a user on the movable component (or on a component associated with the movable component) will cause the movable component to move to a closed position and to lock into that closed position. These segments are further configured to provide guidance to the pathway follower such that upon the occurrence of a second push by the user, the movable component (or the component associated with the movable component) will move to an open position.

In a typical push-push latch arrangement, the movable component is urged by a biasing member (e.g., a spring) towards a first position or an open position. When a user initially pushes on the movable component, or on another component associated with the movable component, the push-push pathway will guide the pathway follower along the ingress segment towards the confinement segment. Towards the latter part of the initial push, the pathway follower may enter the over-shoot segment. The overshoot segment is typically located at the rear of the egress segment and contains a dead end that obstructs further forward movement of the pathway follower. When the pathway follower impacts the dead end of the over-shoot segment, this impact causes the pathway follower and the entire movable component to abruptly stop moving in the forward direction. This abrupt cessation of movement provides haptic feedback to the user that informs the user that he or she should discontinue pushing on the movable component.

When the user discontinues pushing on the movable component, the biasing member will begin to move the movable component back in the opposite direction towards the first or open position. However, because of the contours of the egress segment and/or the contours of the overshoot segment, the pathway follower is not able to back out of push-push pathway along the egress segment. Rather, once the user discontinues the initial push, the biasing member and the overshoot segment and/or the egress segment guide the pathway follower to enter the confinement segment. The confinement segment is configured to obstruct the movable component from returning to the open position and the movable component is now "locked" in the second or closed position.

Upon the occurrence of a subsequent push by the user, the contours of the confinement segment will cause the pathway follower to exit the confinement segment and remain poised at the entrance to the egress segment. When the user stops pushing and releases the movable component, the biasing member will once again urge the movable component towards the first or open position. At this point, the contours of the confinement segment will inhibit the pathway follower from reentering the confinement segment, thus causing the pathway follower to enter the egress segment.

The egress segment is configured to permit the pathway follower to move in the direction urged by the biasing member (i.e, towards the first or open position), thus permitting the movable component to move towards its open position. At the end of the egress segment, the pathway follower is positioned to re-enter the ingress segment for the next lock/unlock cycle.

To enable the pathway follower to move through the push-push pathway as the movable component moves between the first position and the second position, the latch component and the movable component are configured to move with respect to one another. In some examples, the latch component is configured to move laterally with respect to the movable component. This ability of the latch component and the movable component to move laterally with respect to one another permits the pathway follower to move laterally along the push-push pathway in response to the camming forces exerted by the walls of the push-push pathway. In this manner, the pathway follower is enabled to move both longitudinally along the push-push pathway and also laterally with respect to the push-push pathway.

A conventional push-push arrangement does not include any limitation on the rate at which the latch component moves laterally with respect to the movable component (or vice versa). For this reason, during a collision, a conventional push-push arrangement may react to the impulse force of a collision in the same manner that it would react to the force of a user's push, i.e., the pathway follower may be directed from the confinement segment to the egress segment and the movable component (e.g., a storage bin lid) and may come open under the urging of the biasing member.

The present disclosure adds the damper to the push-push arrangement. The damper may be engaged with either the movable component or the latch component. In the example described above, the damper will slow lateral movement of the latch component with respect to the movable component. In the example disclosed herein, the confinement segment is oriented laterally with respect to the push-push pathway. Therefore lateral movement of the pathway follower through the push-push pathway occurs when the pathway follower is disposed in the confinement segment of the push-push pathway. Accordingly, movement of the pathway follower through the confinement segment of the push-push pathway will be dampened or retarded. Thus, movement of the pathway follower through the confinement segment of the push-push pathway is controlled by the damper.

As is the case with conventional dampers, the resistive force offered by the damper is directly proportional to the force exerted on the damper. Thus, in the face of a moderate, steady force applied over a relatively lengthy period of time, as would be the case when a user pushes on the movable component to open it (e.g. 0.3 seconds), the damper will offer little resistance to the lateral movement of the latch component with respect to the movable component and will therefore not substantially slow the movement of the pathway follower through the confinement segment of the push-push pathway.

However, when the damper is faced with a relatively high force exerted over a relatively short period of time, as would be the case when the vehicle is involved in a collision (e.g., 0.5 milliseconds), the damper will offer much greater resistance to the lateral movement of the latch component with respect to the movable component and will substantially slow the movement of the pathway follower through the confinement segment of the push-push pathway. By slowing the movement of the pathway follower through the confinement segment of the push-push pathway, the pathway follower is not able to reach the egress segment before the impulse force of the collision dissipates. Once the impulse force of the collision dissipates, there is no other force that is available to drive the pathway follower onwards towards the egress segment. Accordingly, the pathway follower will remain locked in the confinement segment and the movable component is unable to move to its open position. By selecting a damper that provides a desired amount of resistance, the amount of time taken by the pathway follower to move to the egress segment can be tailored to meet most desired time requirements. This permits designers to prevent movable components from unintentionally opening during head on or rear end collisions. So long as the damper employed by the push-push latch arrangement causes the pathway follower to take longer than a predetermined amount of time before entering the egress segment (e.g., about five milliseconds), then the force exerted on the movable component during the collision will dissipate before the pathway follower can exit the confinement segment and move into the egress segment. Therefore, the movable component will remain locked despite the impulse force of the collision.

An additional advantage of the push-push latch arrangement disclosed herein is that both the movable component and the latch component may pivot as they move. This permits a simple construction that utilizes well known components that are readily available in the market.

An additional advantage of the push-push latch arrangement disclosed herein is that the damper may comprise a viscous rotary damper. Such dampers are well known, readily available, relatively inexpensive and are dimensioned to easily fit within a limited package space and have various viscosities.

A greater understanding of the push-push latch arrangement described above may be obtained through a review of the illustrations accompanying this application together with a review of the detailed description that follows.

FIG. 1 is a perspective view illustrating an interior portion 20 of a vehicle. Interior 20 includes a dashboard 22 having a storage bin cover 24. Storage bin cover 24 is configured to move between a closed position (as illustrated in FIG. 1) and an open position (see FIG. 7). When moving to the open position, storage bin cover 24 pivots in an upward direction. It therefore requires the assistance of a biasing component, such as a spring, to open when unlatched. Movement of storage bin cover 24 is controlled by an embodiment of the push-push latch arrangement disclosed herein. For this reason, storage bin cover 24 lacks any visible release mechanism on its surface and accordingly has a visual appearance that is more aesthetically pleasing than conventional instrument mounted storage bin covers.

Figure 2:
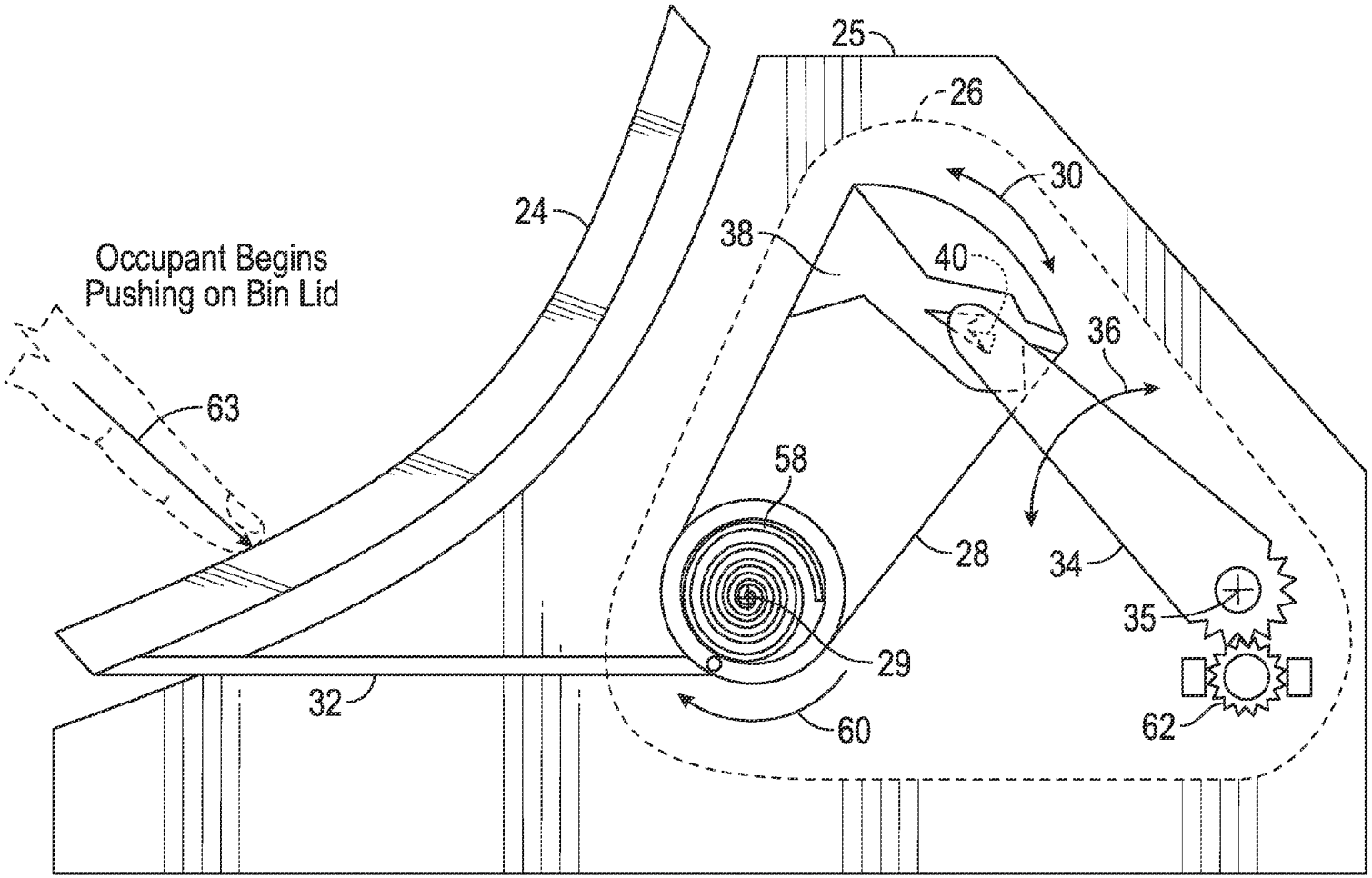
FIG. 2 is a schematic view illustrating a non-limiting embodiment of the push-push latch arrangement of the present disclosure coupled with the storage bin cover of FIG. 1 when a vehicle occupant begins to push on the storage bin cover, thereby initiating an opening cycle of the push-push latch arrangement.

FIG. 2 is a schematic view illustrating a non-limiting embodiment of a push-push latch arrangement 26 of the present disclosure coupled with the storage bin cover of FIG. 1. Storage bin cover 24 is configured to pivot with respect to a storage bin 25 between an open position (see FIG. 6) and a closed position as illustrated in FIG. 2. In the illustrated embodiment, storage bin 25 is integrated into dash board 22 (see FIG. 1). In other embodiments, push-push latch arrangement 26 may be used in conjunction with any other component including, but not limited to any movable trim component associated with the interior of a vehicle as well as any aftermarket component that moves between an open and a closed position or between a locked and an unlocked condition.

Push-push latch arrangement 26 includes a movable component 28. Movable component 28 is configured to pivot back and forth about a pivot axis 29 in the directions indicated by arrow 30. Movable component 28 is linked to storage bin cover 24 via connecting rod 32. Accordingly, as movable component 28 pivots in a clockwise direction (from the perspective of FIG. 2), connecting rod 32 will cause storage bin cover 24 to pivot towards its open position. Conversely, when movable component 28 pivots in a counter-clockwise direction (from the perspective of FIG. 2), connecting rod 32 will cause storage bin cover 24 to pivot towards its closed position.

Push-push latch arrangement 26 further includes a latch component 34. Latch component 34 is configured to pivot back and forth about a pivot axis 35 in the directions indicated by arrow 36.

A push-push pathway 38 is defined in a surface of movable component 28 and a pathway follower 40 is attached (or, in some embodiments, integrated into) latch component 34. In other embodiments, the push-push pathway may be defined in a surface of latch component 34 and the pathway follower may be attached to movable component 28 without departing from the teachings of the present disclosure. Latch component 34 engages with movable component 28 via the interactions between pathway follower 40.

Figure 3:
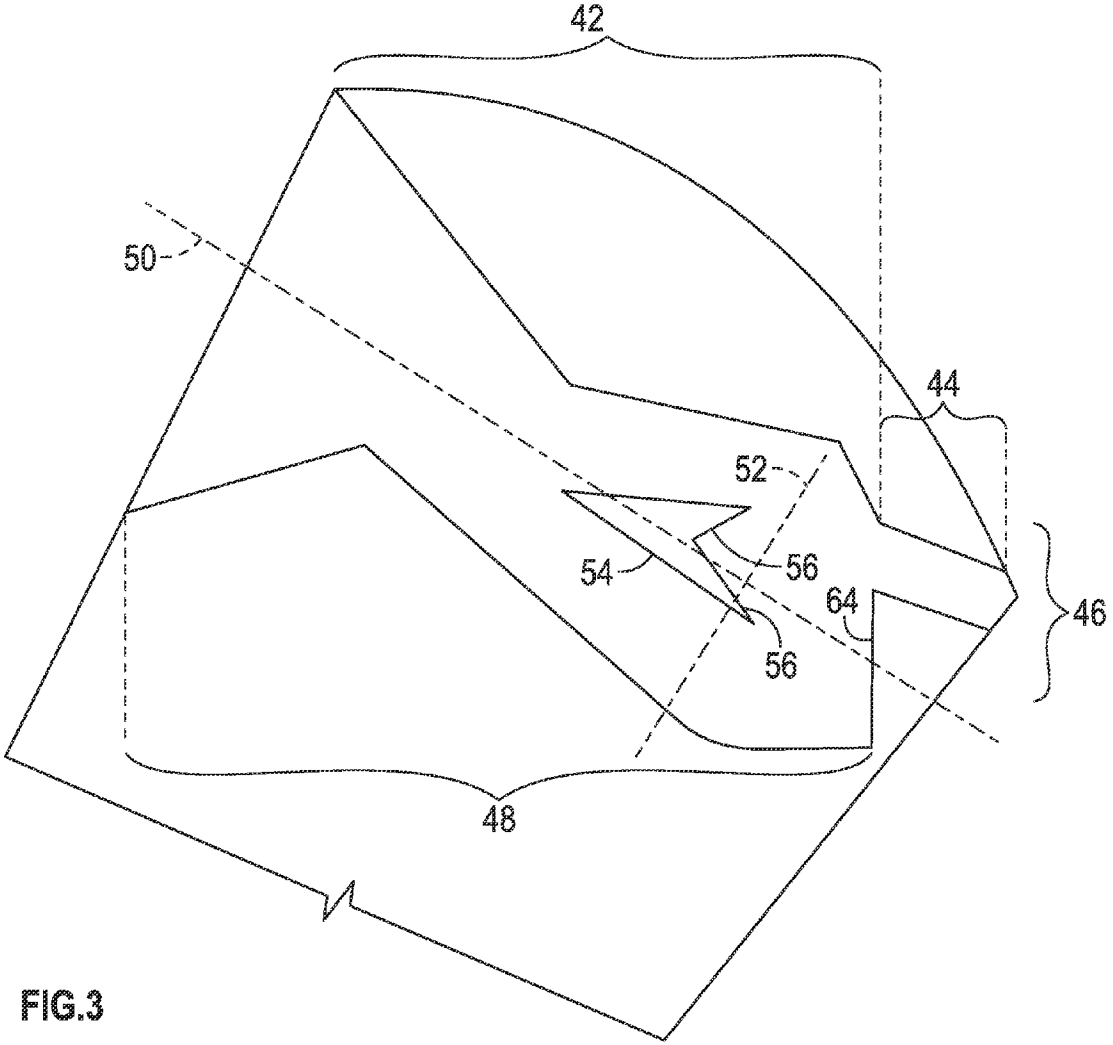
FIG. 3 is an fragmentary expanded schematic view illustrating the push-push pathway of the push-push latch arrangement of FIG. 2.

FIG. 3 is an expanded fragmentary view illustrating push-push pathway 38. In this view, the various segments of push-push pathway 38 are shown in greater detail. As illustrated, push-push pathway 38 includes an ingress segment 42, an over-shoot segment 44, a confinement segment 46, and an egress segment 48. These segments are all contiguous with one another and thereby permit pathway follower 40 (see FIG. 2) to transition without obstruction between the different segments. As also illustrated in FIG. 3, ingress segment 42, over-shoot segment 44, and egress segment 48 are each oriented along a longitudinal axis 50 of push-push pathway 38 while confinement segment 46 is oriented along a lateral axis 52 of push-push pathway 38. Push-push pathway 38 further includes a center body 54 which borders ingress segment 42, confinement segment 46, and egress segment 48 and which includes a constraining wall 56 that is configured to engage and cooperate with pathway follower 40 (see FIG. 2) to lock movable component 28 (see FIG. 2) in the closed position.

Returning to FIG. 2, and with continuing reference to FIG. 3, movable component 28 is illustrated in a closed position with pathway follower 40 engaged with, and constrained by, constraining wall 56. In this position, movable component 28 is inhibited from pivoting in the clockwise direction (from the perspective of FIG. 2) towards an open position because of the obstruction caused by engagement of pathway follower 40 with constraining wall 56.

Push-push latch arrangement 26 further includes a spring 58 engaged with movable component 28. Spring 58 is configured to exert a torque on movable component 28 that urges movable component 28 in the clockwise direction as indicated by arrow 60. As a result of the urging of spring 58, movable component 28 is urged towards the open position. Consequently, once pathway follower 40 comes out of engagement with constraining wall 56, movable component 28 will move towards the open position.

Push-push latch arrangement 26 further includes a damper 62 engaged with latch component 34. In the illustrated embodiment, damper 62 comprises a viscous rotary damper that is configured to dampen or slow the movement of latch component 34 in the direction indicated by arrow 36. The greater the torque that is applied to latch component 34, the greater will be the resistance that damper 62 offers to rotational movement of latch component 34.

As illustrated in FIG. 2, and with continuing reference to FIG. 3, a vehicle occupant has exerted a force 63 on storage bin cover 24. The application of force 63 will be transmitted to movable component 28 through connecting rod 32 and will impart a torque to movable component 28 that is sufficient to overcome the torque exerted by spring 58. Therefore, as a result of the vehicle occupant's push on storage bin cover 24, movable component 28 will begin to move in a counter-clockwise direction (from the perspective of FIG. 2). This counter-clockwise movement of movable component 28 will cause pathway follower 40 to come out of engagement with constraining wall 56 and encounter a camming wall 64 of confining segment 46.

Camming wall 64 will cause pathway follower 40 to move in a downward direction (from the perspective of FIG. 3) along lateral axis 52. Such camming force acting on pathway follower 40 exerts a torque on latch component 34 about pivot axis 35. This torque will be opposed by damper 62 in proportion to the magnitude of the torque. Damper 62 can be selected or tuned such that when it encounters typical torque forces exerted by vehicle occupants attempting to open a storage bin, damper 62 will offer little resistance and not substantially retard the pivotal movement of latch component 34.

Figure 4:
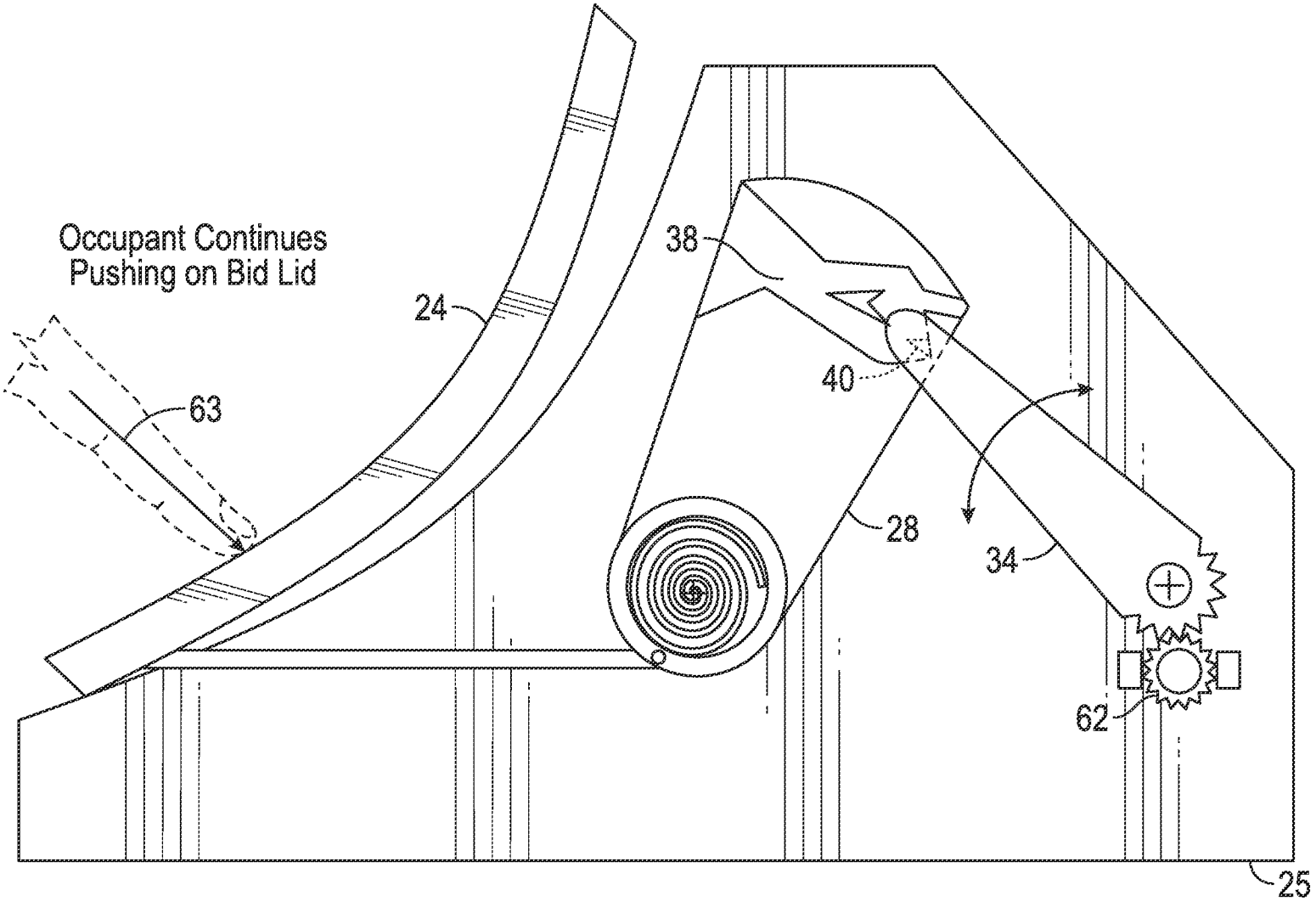
FIG. 4 is a schematic view illustrating the push-push latch arrangement of FIG. 2 during a subsequent stage of an opening cycle initiated by a vehicle occupant.

With respect to FIG. 4, and with continuing reference to FIG. 3, force 63 is still being applied by the vehicle occupant. Force 63 has caused storage bin cover 24 to move inward towards storage bin 25. This movement has caused movable component 28 to pivot in a counter-clockwise direction (from the perspective of FIG. 4) and has further caused pathway follower 40 to encounter camming wall 64. This, in turn, has caused pathway follower 40 to move laterally along confinement segment 46. Because force 63 is a relatively low force applied over a relatively long period of time, damper 62 offers little resistance to the pivoting of latch component 34, leaving pathway follower 40 relatively free to move along confinement segment 46 towards an entrance to egress segment 48. Once pathway follower 40 reaches the entrance to egress segment 48, it is disposed in a position where it can move longitudinally along egress segment 48 without encountering constraining wall 56, and thus will be substantially unobstructed from moving along egress segment 48.

Figure 5:
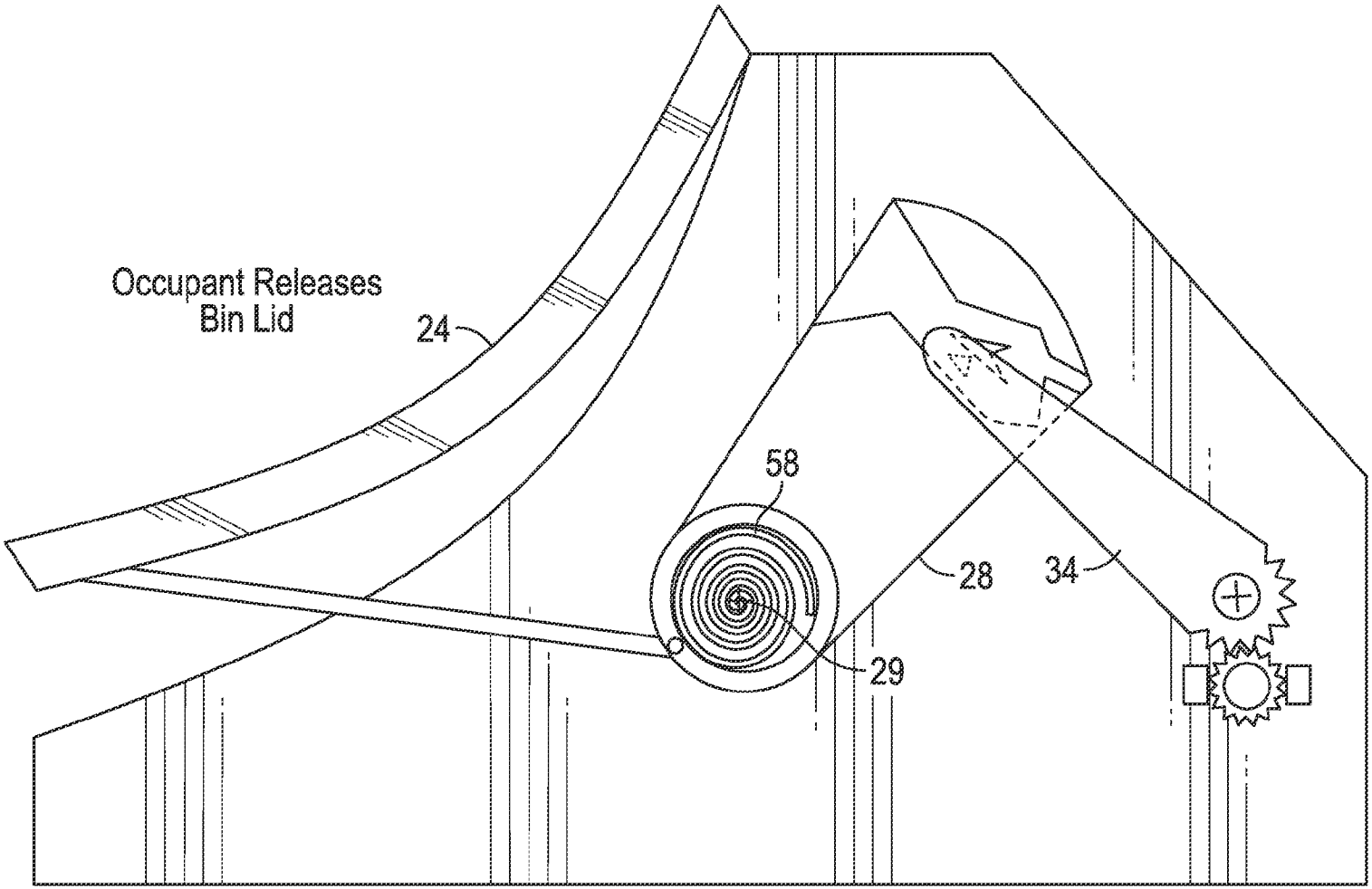
FIG. 5. is a schematic view illustrating the push-push latch arrangement of FIG. 4 during a subsequent stage of an opening cycle initiated by a vehicle occupant.

With respect to FIG. 5, and with continuing reference to FIGS. 2-4, the vehicle occupant has released storage bin cover 24 and, consequently, has ceased application of force 63. In some embodiments, the vehicle occupant will release storage bin cover 24 when pathway follower 40 reaches the end of confinement segment 46. In some embodiments, there may be an abrupt change in the direction of push-push pathway 38 as pathway follower 40 reaches the end of confinement segment 46 and encounters egress segment 48. This abrupt change in direction may provide the vehicle occupant with haptic feedback indicating that it is time to stop pushing on storage bin cover 24.

Once the vehicle occupant has released storage bin cover 24, the torque exerted by spring 58 on movable component 28 causes movable component 28 to pivot about pivot axis 29 in a clockwise direction (from the perspective of FIG. 5). Because pathway follower 40 is no longer positioned in the confinement segment, it is does not engage with constraining wall 56, but rather is free to move along egress segment 48.

Figure 6:
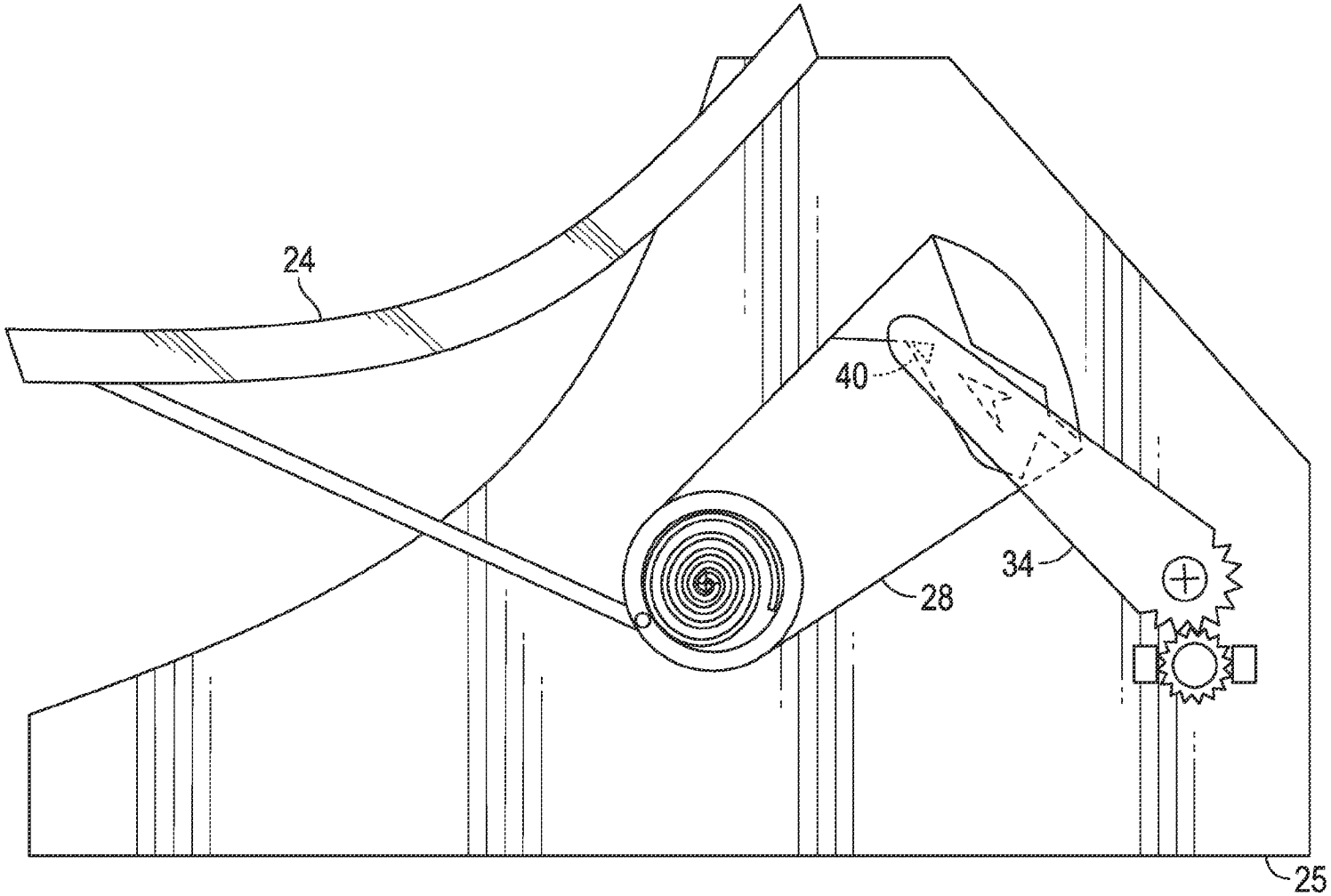
FIG. 6 is a schematic view illustrating the push-push latch arrangement of FIG. 5 during a subsequent stage of an opening cycle initiated by a vehicle occupant.
Figure 7:
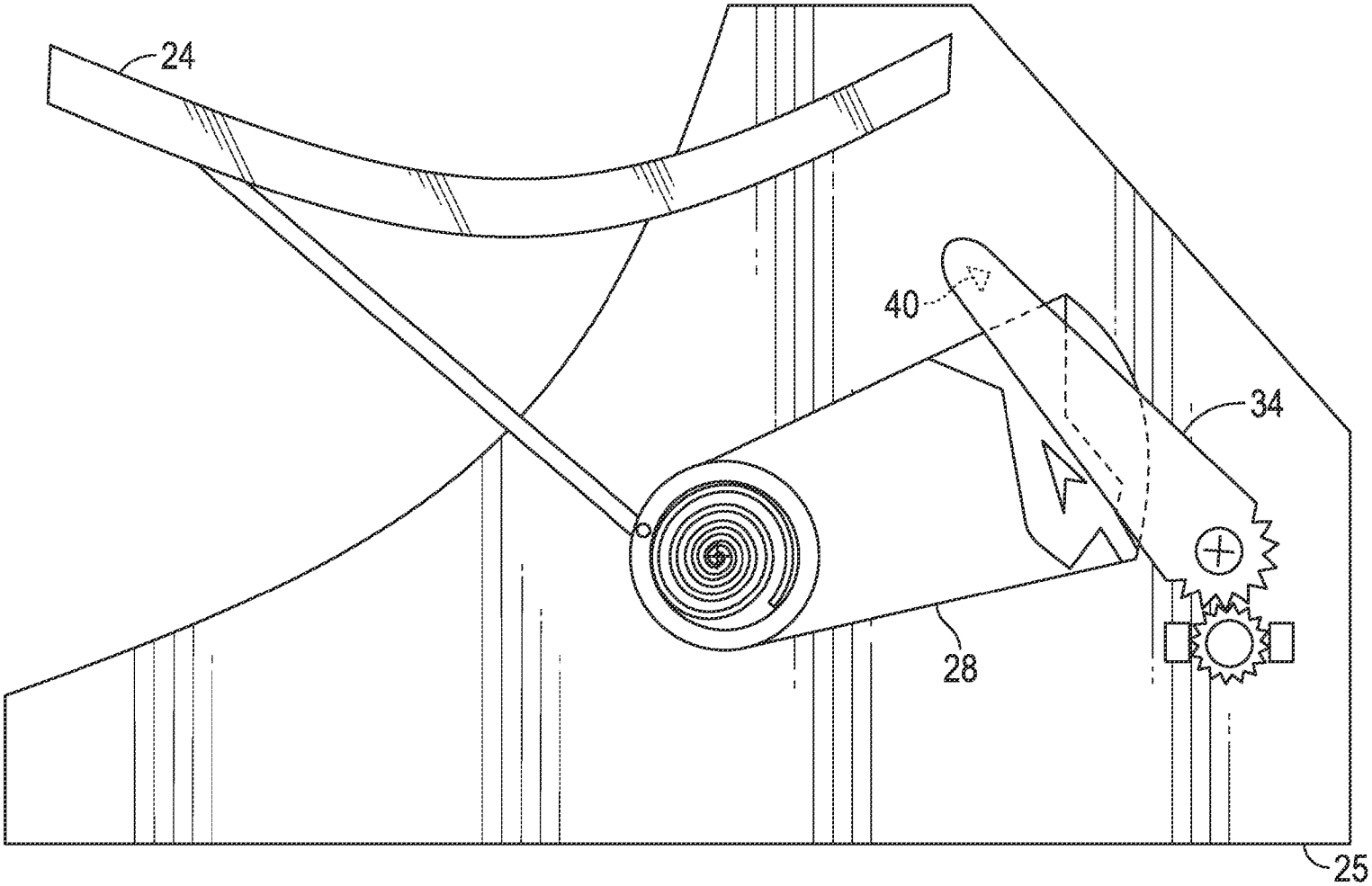
FIG. 7 is a schematic view illustrating the push-push latch arrangement of FIG. 6 during a final stage of an opening cycle initiated by a vehicle occupant.

With respect to FIGS. 6-7, and with continuing reference to FIGS. 2-5, movable component 28 continues to pivot clockwise towards the open position, causing pathway follower 40 to move longitudinally along egress segment 48. This, in turn, causes storage bin cover 24 to move to its open position, as illustrated in FIG. 7, thereby allowing a vehicle occupant to gain access to storage bin 25. With respect to FIG. 7, movable component 28 resides in the open position and pathway follower 40 is positioned to reenter ingress segment 42.

Figure 8:
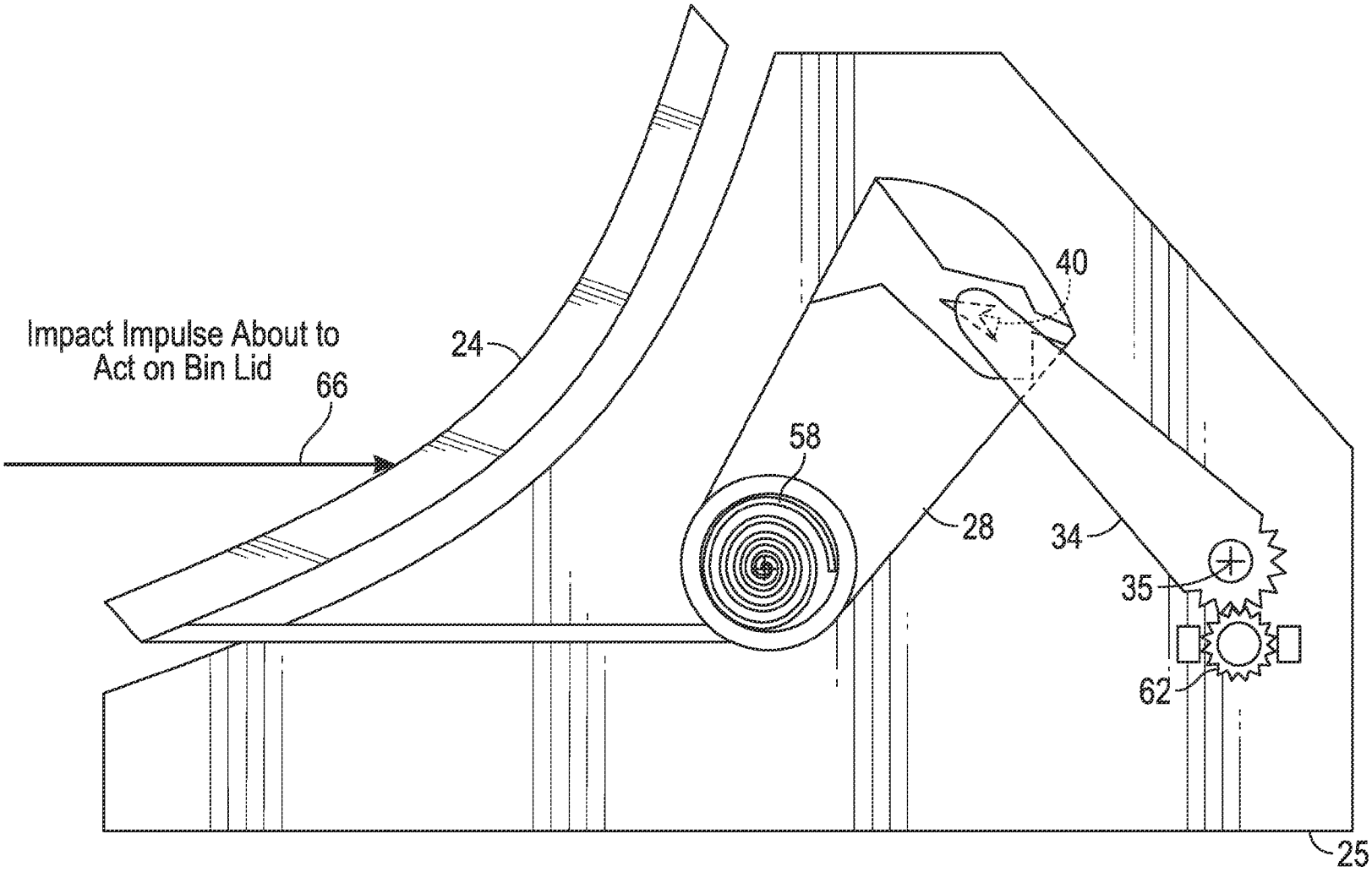
FIG. 8 is a schematic view illustrating the push-push latch arrangement of FIG. 2 during the onset of an impulse force, caused by a vehicle collision, acting on the push-push latch arrangement.
Figure 9:
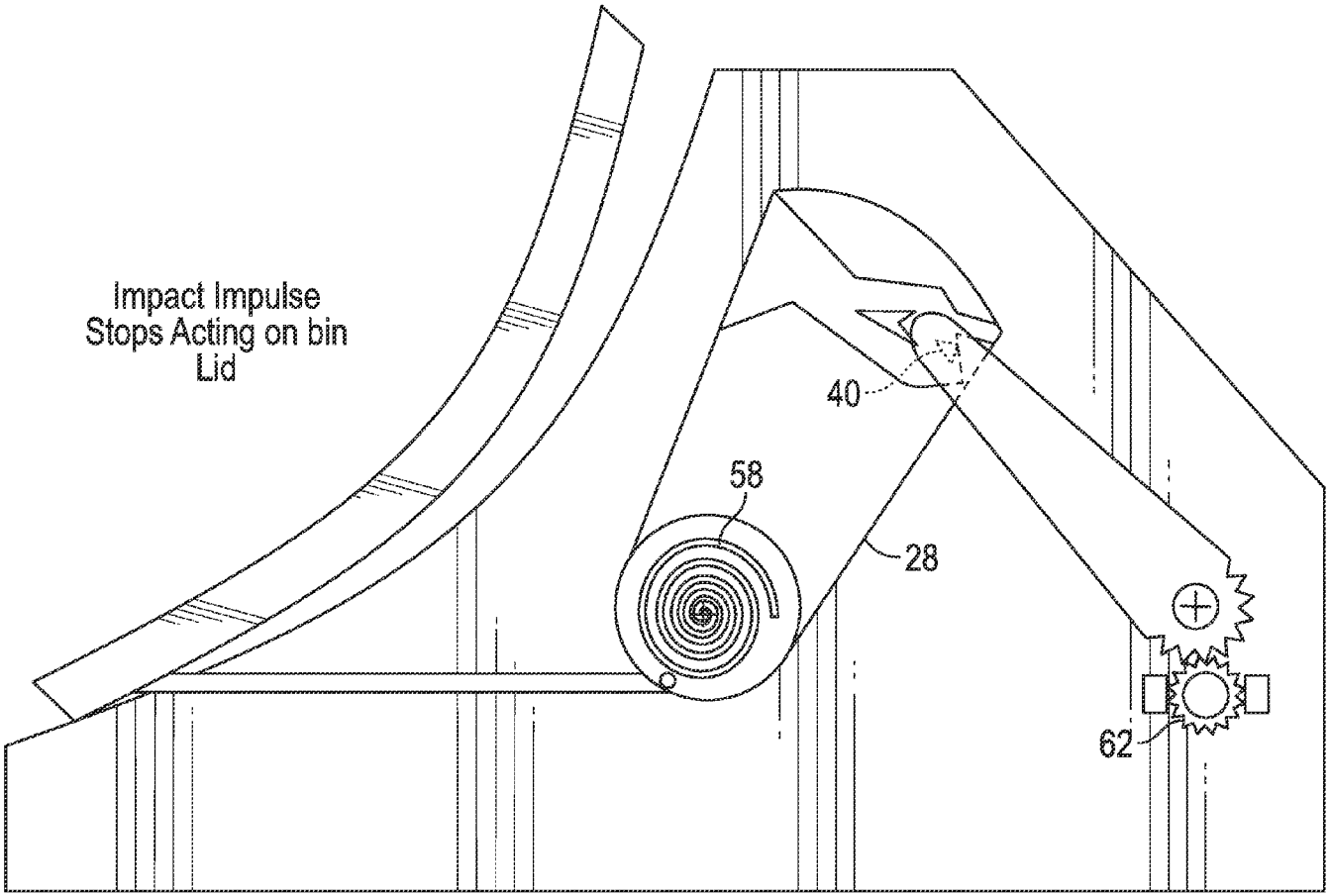
FIG. 9 is a schematic view illustrating the push-push latch arrangement of FIG. 8 after the impulse force has dissipated and showing that that push-push latch arrangement has moved only partially towards an unlocked condition in response to the impulse force.
Figure 10:
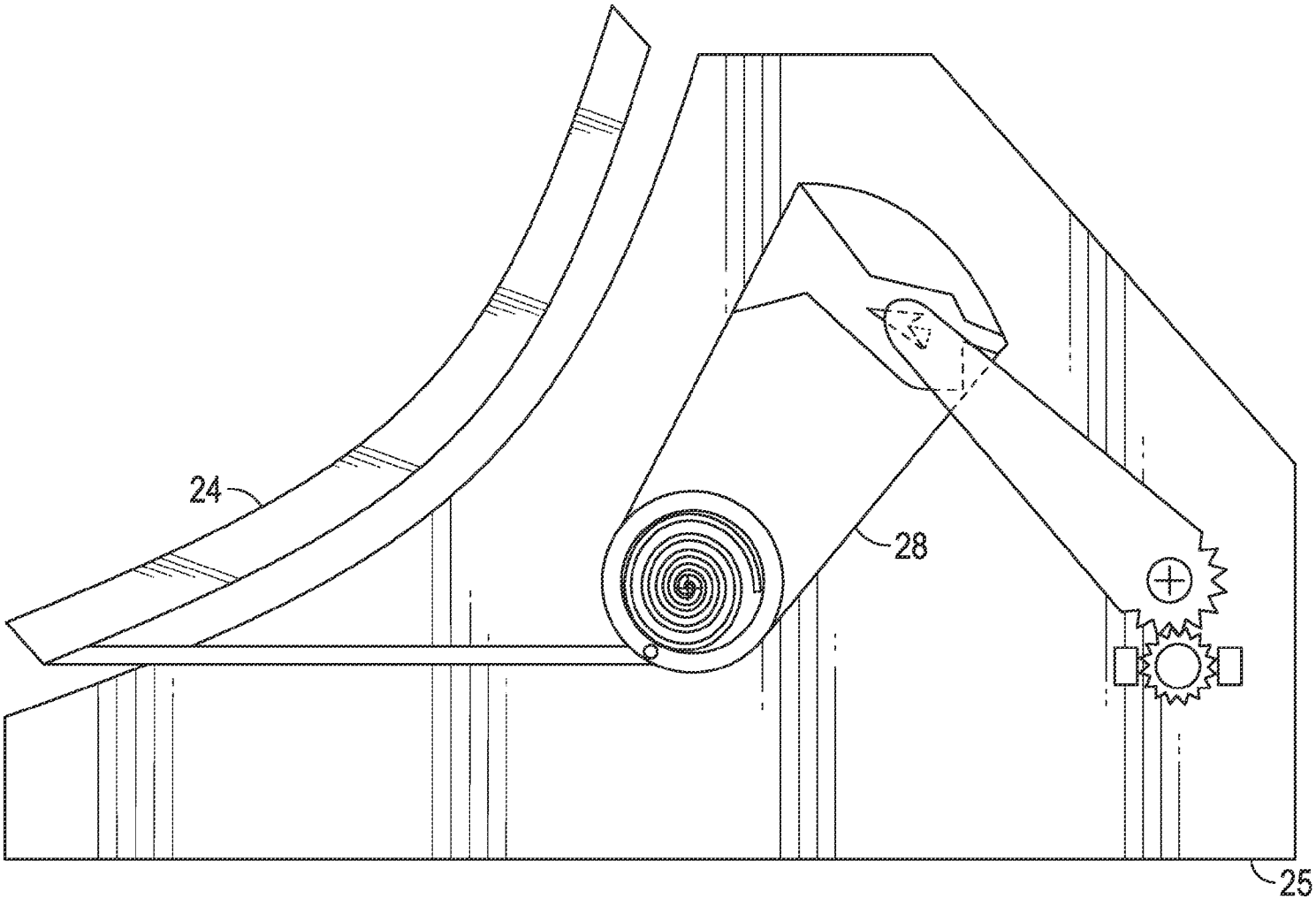
FIG. 10 is a schematic view illustrating the push-push latch arrangement of FIG. 9 after it has returned to a locked condition subsequent to the dissipation of the impulse force of the collision.

With respect to FIGS. 8-10, and with continuing reference to FIGS. 2-7, movable component 28 is disposed in the closed position (FIG. 8), as is storage bin cover 24. While in this position, pathway follower 40 of latch component 34 is engaged with constraining wall 56 and this engagement prevents movable component 28 from pivoting under the urging of spring 58 to the open position illustrated in FIG. 7.

An impulse force 66 caused by a vehicle collision acts on storage bin cover 24. Impulse force 66 is of much greater magnitude than force 63, but of much shorter duration. A typical impulse force caused by a vehicle collision lasts for a duration of approximately five milliseconds.

In the absence of opposition, impulse force 66 would cause storage bin cover 24 to rotate inwardly towards storage bin 25, which, in turn, would rotate movable component 28 in the counter-clockwise direction and would move pathway follower 40 out of engagement with constraining wall 56. Pathway follower 40 would then be driven into egress segment 48 by the camming force exerted by camming wall 64, leading to the result that storage bin cover 24 would come open.

However, push-push latch arrangement 26 does offer opposition to impulse force 66. Specifically, damper 62 opposes impulse force 66. Significantly, the opposition (dampening) offered by damper 62 to impulse force 66 is directly proportional to the magnitude of impulse force 66. Because impulse force 66 is substantially greater than force 63, the dampening provided by damper 62 in opposition to impulse force 66 will be correspondingly greater than the dampening provided by damper 62 in opposition to force 63. Consequently, damper 62 inhibits latch component 34 from pivoting about pivot axis 35 beyond a predetermined rotational rate regardless of the magnitude of impulse force 66. Correspondingly, pathway follower 40 is inhibited by damper 62 from moving laterally along confining segment 46 beyond a predetermined rate.

In the illustrated embodiment, damper 62 will retard the movement of pathway follower 40 along confining segment 46 such that pathway follower 40 will require more time to move laterally beyond constraining wall 56 than the period of time that impulse force 66 acts on storage bin cover 24. In other words, impulse force 66 dissipates before pathway follower 40 has a chance to move all the way to the entrance to egress segment 48. This is illustrated in FIG. 9.

As seen in FIG. 9, impulse force 66 has completely dissipated before pathway follower 40 has moved into egress segment 48. Consequently, once movable component 28 pivots in the clockwise direction (with respect to FIG. 2) under the urging of spring 58, pathway follower 40 will be driven back into engagement with constraining wall 56, and movable component 28 will be locked into the closed position. Thus, as illustrated in FIG. 10, even though the magnitude of impulse force 66 is far greater than the magnitude of force 63, movable component 28 returns to the closed position after impulse force 66 dissipates, with the result that storage bin cover 24 remains closed over storage bin 25.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

What is claimed is:

1. A push-push latch arrangement comprising:

an actuator mounted to a first interior surface of the vehicle, the actuator configured to move between an actuated position and an unactuated position;

a movable component adapted for mounting to a second interior surface of a vehicle, the movable component coupled with the actuator and configured to move between a first position and a second position as the actuator moves between the unactuated position and the actuated position, respectively;

a link directly and continuously linking the movable component to the actuator, the link moving the movable component between the first position and the second position as the actuator moves between the unactuated position and the actuated position, respectively;

a latch component configured to engage the movable component, the latch component configured to move with respect to the movable component as the movable component moves between the first position and the second position;

a push-push pathway associated with either the movable component or the latch component, the push-push pathway having an ingress segment, a confining segment, and an egress segment;

a pathway follower associated with the other of either the movable component or the latch component, the pathway follower engaged with the push-push pathway; and a damper directly engaged with the latch component, the damper configured to retard movement of the latch component with respect to the movable component, wherein the damper is configured to retard movement of the latch component such that the pathway follower requires at least about five milliseconds to move from the confining segment to the egress segment.

2. The push-push latch arrangement of claim 1, further comprising a biasing member associated with the movable component, the biasing member biasing the movable component towards the first position.

3. The push-push latch arrangement of claim 2, wherein the biasing member comprises a spring.

4. The push-push latch arrangement of claim 1, wherein the damper comprises a viscous damper.

5. The push-push latch arrangement of claim 1, wherein the damper comprises a rotary damper.

6. The push-push latch arrangement of claim 1, wherein the damper comprises a viscous rotary damper.

7. The push-push latch arrangement of claim 1, wherein the movable component pivots between the first position and the second position.

8. The push-push latch arrangement of claim 1, wherein the first position comprises an open position and wherein the second position comprises a closed position.

9. The push-push latch arrangement of claim 1, wherein the movable component comprises a trim component.

10. The push-push latch arrangement of claim 9, wherein the movable component is associated with a lid of a storage bin.

11. The push-push latch arrangement of claim 10, wherein the lid is integrated into an instrument panel of the vehicle.

12. The push-push latch arrangement of claim 1, wherein the latch component moves laterally with respect to the movable component as the movable component moves between the first position and the second position.

13. A push-push latch arrangement comprising:

an actuator mounted to a first interior surface of the vehicle, the actuator configured to move between an actuated position and an unactuated position;

a movable component adapted for mounting to a second interior surface of a vehicle, the movable component coupled with the actuator and configured to move between a first position and a second position as the actuator moves between the unactuated position and the actuated position, respectively;

a link directly and continuously linking the movable component to the actuator, the link moving the movable component between the first position and the second position as the actuator moves between the unactuated position and the actuated position, respectively;

a latch component configured to engage the movable component, the latch component configured to move with respect to the movable component as the movable component moves between the first position and the second position;

a push-push pathway associated with the movable component, the push-push pathway having an ingress segment, a confining segment, and an egress segment;

a pathway follower associated with the latch component, the pathway follower engaged with the push-push pathway; and a damper directly engaged with the latch component, the damper configured to retard movement of the latch component with respect to the movable component.

* * * * *